US008262438B1

(12) United States Patent
Allison et al.

(10) Patent No.: US 8,262,438 B1
(45) Date of Patent: Sep. 11, 2012

(54) KNIFE SHARPENER

(76) Inventors: Clay A. Allison, Santa Fe, NM (US); Douglas E. Kennemore, Rowe, NM (US)

( * ) Notice: Subject to any disclaimer, the term of this patent is extended or adjusted under 35 U.S.C. 154(b) by 1009 days.

(21) Appl. No.: 12/168,759

(22) Filed: Jul. 7, 2008

Related U.S. Application Data

(60) Provisional application No. 60/948,320, filed on Jul. 6, 2007.

(51) Int. Cl.
*B24B 3/36* (2006.01)

(52) U.S. Cl. ..... 451/321; 451/45; 451/367; 451/371

(58) Field of Classification Search ..... 76/82.2, 76/83, 89.1, 89.2; 451/45, 65, 66, 293, 321, 451/356, 367, 371, 361, 372
See application file for complete search history.

(56) References Cited

U.S. PATENT DOCUMENTS 2,116,343 A * 5/1938 Davis ..... 76/82.2
2,528,943 A * 11/1950 Calabrese ..... 451/175
4,216,627 A * 8/1980 Westrom ..... 451/175
4,404,873 A * 9/1983 Radish ..... 76/82
4,441,279 A * 4/1984 Storm et al. ..... 451/175
4,538,382 A * 9/1985 Johannsen ..... 451/175
4,602,531 A * 7/1986 Korhonen ..... 76/82
4,777,770 A * 10/1988 LeVine ..... 451/557
5,185,958 A * 2/1993 Dale ..... 451/174
5,195,275 A * 3/1993 McLean ..... 451/175
6,146,257 A * 11/2000 Himeno et al. ..... 451/321
7,413,504 B2 * 8/2008 Lytinas ..... 451/67
2007/0249268 A1 * 10/2007 Swartz ..... 451/349
2011/0159791 A1 * 6/2011 Heng ..... 451/371
2011/0177764 A1 * 7/2011 Schwartz ..... 451/371

* cited by examiner

*Primary Examiner* — Timothy V Eley
(74) *Attorney, Agent, or Firm* — Todd E. Rinner

(57) ABSTRACT

An apparatus for sharpening a knife comprising a clamping mechanism for holding the knife and a base rod mounted adjacent and perpendicular to said clamping mechanism. Two sharpening blocks are located on either side of the clamping mechanism and are slidably mounted on guide rods extending vertically from the base rod. The guide rods are movably fixed to any point along the base rod and can be moved about the selected point in two directional planes that are perpendicular to each other.

23 Claims, 3 Drawing Sheets

KNIFE SHARPENER

CROSS-REFERENCE TO RELATED APPLICATIONS

This application claims priority to and the benefit of the filing of U.S. Provisional Patent Application Ser. No. 60/948,320, entitled "Knife Sharpener" filed on Jul. 6, 2007, and the specification thereof is incorporated herein by reference.

FIELD OF THE INVENTION

The present invention relates to knife sharpeners, and more particularly to a manual reciprocating sharpener with dual sharpening blocks.

BACKGROUND OF THE INVENTION

Numerous knife sharpening systems are available, with many typically including a clamping device for holding a knife in a fixed position and a hand-held sharpening hone or block. The sharpening block may be slid across the cutting edge of the knife at a prescribe angle. Prior art systems are flimsy, limited in adjustment and/or selection of the prescribed angle, unstable, and incapable of setting a consistent relative position and angle between the cutting edge of a knife and the sharpening block over repeated sharpening sessions. A number of prior art systems will now be described.

Longbrake, U.S. Pat. No. 7,144,310, discloses an adjustable knife sharpener apparatus. The apparatus includes a clamping mechanism operable to secure a knife blade, and at least one adjustable guide rod coupled to the clamping mechanism to adjust a sharpening angle of the knife sharpener apparatus. The apparatus further includes a first guide rod coupled to a first clamp member, and a first infinitely adjustable guide loop coupled to the first guide rod to adjust a sharpening angle of the knife sharpener apparatus. Longbrake lacks, among other things, a means of securely affixing a guide rod in an adjustable fixed position wherein the guide rod is coupled to a stable base with a clamping mechanism, as well as a means for repeatably and verifiably controlling the depth and alignment of the knife blade with respect to the clamping mechanism and the sharpening blocks.

LeVine, U.S. Pat. No. 4,512,112, discloses a sharpener clamp construction comprising first and second clamp members having a first longitudinal axis and first and second ends, respectively, first and second jaws at sais first ends of said first and second clamp members, respectively, for clamping a knife with a second longitudinal axis extending transversely to said first longitudinal axis. LeVine further discloses first and second guide member means formed integrally with and extending outwardly from said first and second clamp members, respectively, at said second end, and a plurality of apertures in said first and second guide member means at different distances from said second end for receiving a guide rod attached to a sharpener stone holder. Levine lacks, among other things, a means of securely affixing a guide rod in an adjustable fixed position wherein the guide rod is coupled to a stable base with a clamping mechanism, as well as a means for repeatably and verifiably controlling the depth and alignment of the knife blade with respect to the clamping mechanism and the sharpening blocks.

SUMMARY OF THE INVENTION

The present invention relates to a method and apparatus for sharpening a knife or other cutting implement. The invention includes a clamping mechanism for holding the knife and attached to a base, as well as a base rod mounted adjacent and perpendicular to said clamping mechanism. Two sharpening blocks are located on either side of the clamping mechanism and are slidably mounted on guide rods extending vertically from the base rod. The guide rods are movably fixed to any point along the base rod and can be moved about the selected point in two directional planes that are perpendicular to each other, thus providing for infinite adjustments. Using the apparatus of the present invention, a knife blade can be sharpened by passing the sharpening blocks along the cutting edge of the knife at a repeatable position and angle over the course of multiple sharpening sessions.

DESCRIPTION OF ATTACHED FIGURES

DESCRIPTION OF PREFERRED EMBODIMENT OF THE INVENTION

Figure 1:
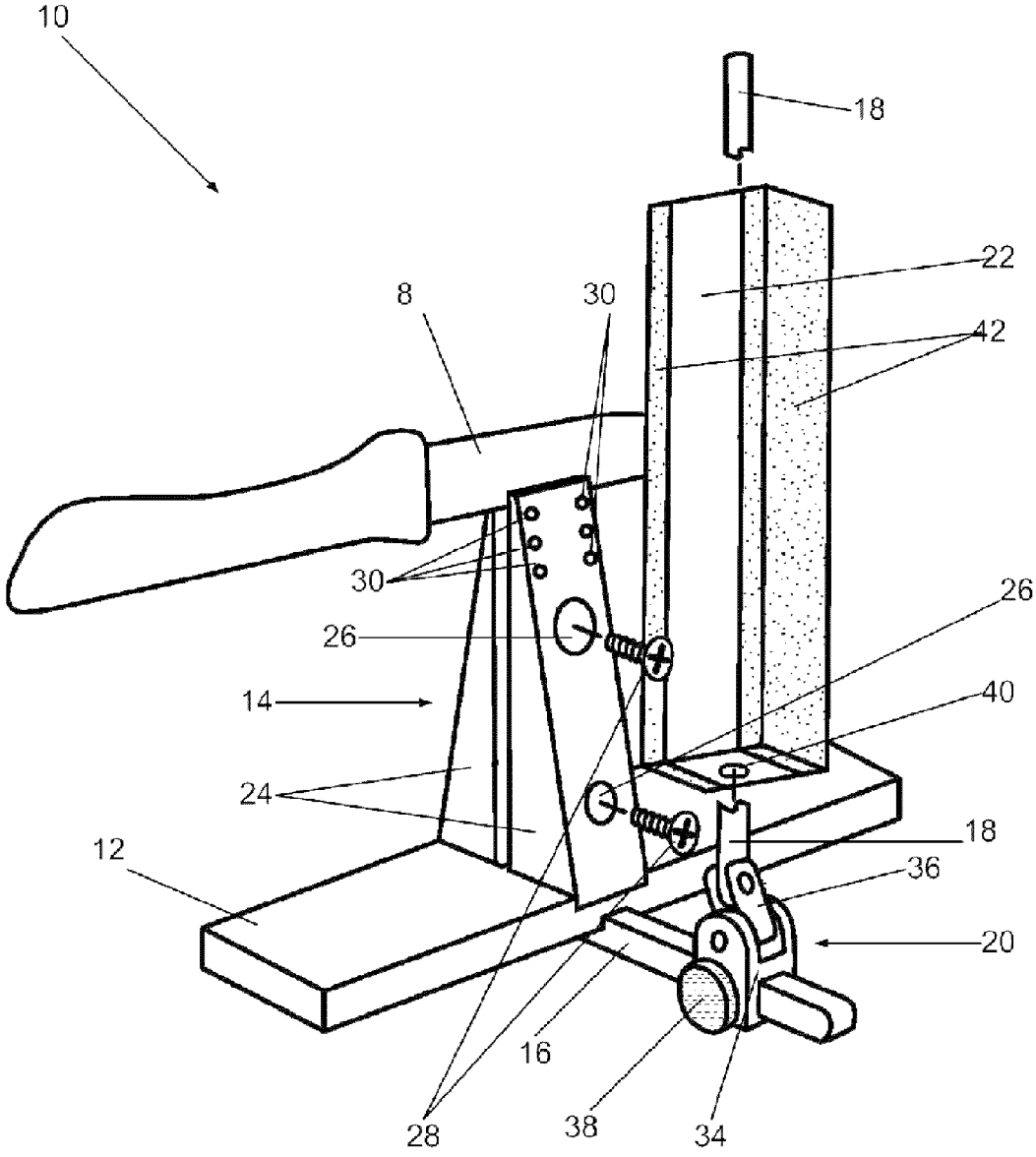
FIG. 1 depicts a perspective view of the knife sharpening assembly of the present invention (with the preferred second sharpening block and related elements not shown for ease of comprehending this figure, and the guide rod partially depicted).
Figure 2:
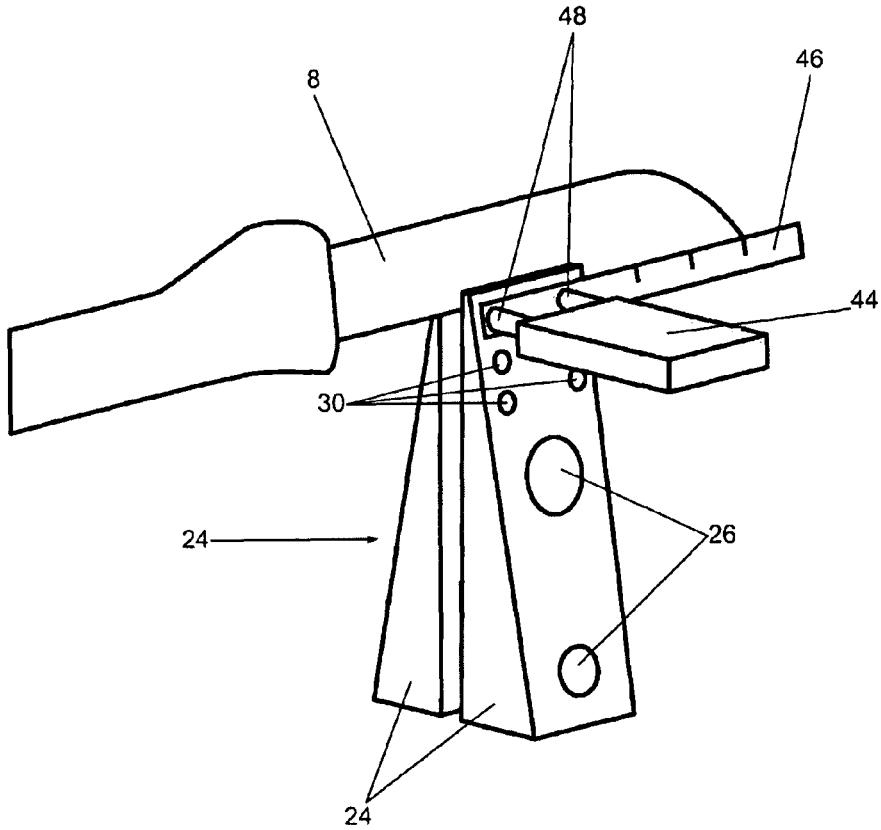
FIG. 2 depicts a perspective view of the clamping mechanism, depth key, and alignment guide of the present invention.
Figure 3:
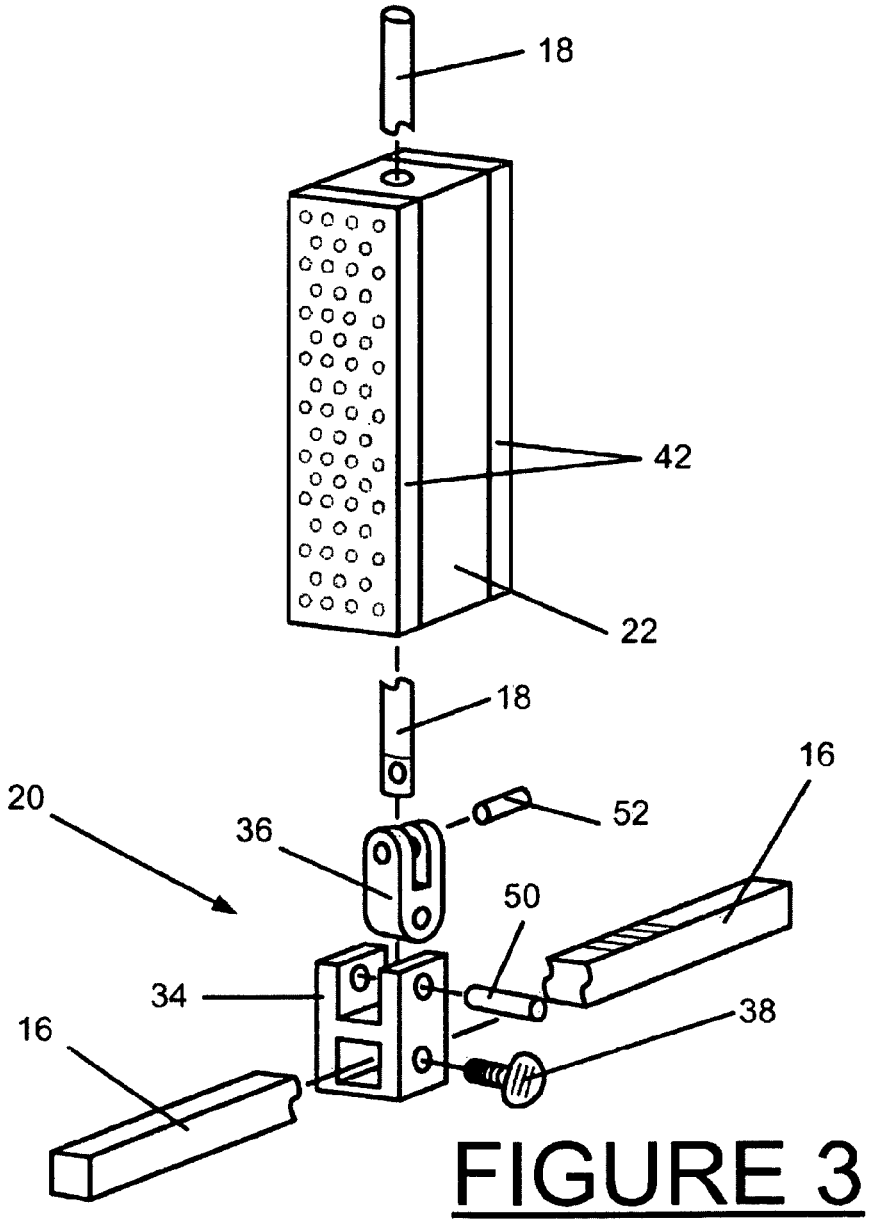
FIG. 3 depicts an exploded view of the preferred guide rod adjustment assembly with a sharpening block depicted as well (with the guide rod and base rod partially depicted).

With reference to FIGS. 1 through 3, the concept and preferred embodiment of the present invention will be described. The present invention is designed to sharpen cutting implements at controlled, adjustable, and consistent angles over the course of multiple sharpening sessions. An abrasive sharpening or honing element (or stone or block) is manually drawn across a cutting edge of a cutting implement at a specified angle using a system of guide rods interfacing with the sharpening element(s) and maintained in a fixed plane relative to the cutting implement.

With reference to FIG. 1, a knife sharpener 10 is shown, which includes a base 12, clamping mechanism 14, base rod 16, guide rod 18, angle adjustment assembly 20, and sharpening block 22 (only one side of the present invention is shown in FIG. 1 for purposes of aiding in the understanding of the invention without complicating FIG. 1, but it is understood that the preferred embodiment has features 16, 18, 20, and 22 on both sides of clamping mechanism 14). Base 12 provides a common element to which the other components of knife sharpener 10 can be joined to create knife sharpener 10. Clamping mechanism 14 includes two vertical members 24 having apertures 26, preferably threaded, that pass through vertical members 24 and align such that vertical members 24 can be coupled together in such a manner so as to securely hold a cutting implement 8 in a fixed position. Vertical members 24 may be coupled together via the use of screws 28 that mate with threaded apertures 26 and extend from one of members 24 to the other. The preferred embodiment uses "allen" screws in conjunction with an allen thumb key/wrench to create greater clamping force than as opposed to other types of screw systems. It is preferred that vertical members 24 are wider at their bases and taper to a thin cross-section as they extend vertically so as to allow a greater range of motion and angle adjustment for guide rod 18 and sharpening block 22, as discussed further below, as well as provide increased clamping power. The thin cross-section at the top of vertical members also allows the present invention to be used in sharpening very small cutting implements (because a thicker cross-section would impede sharpening blocks 22 from approaching and being applied to a cutting edge that was located relatively close to the top of vertical members 24). Vertical members 24 also include depth control apertures 30, also as discussed further below. Vertical members 24 are affixed to base 12 via any sufficiently secure means.

Base rod 16 is secured to base 12 such that base rod 16 is aligned with vertical members 24 and oriented perpendicular to cutting implement 8. In the depicted embodiment, base rod 16 is affixed to the underside of base 12 within a notch or channel 32 that runs across the width of base 12 in line with the center of vertical members 12. Base rod 16 extends out a fixed distance from base 12 in the present embodiment. Attached to base rod 16 is angle adjustment assembly 20 for controlling the angle of guide rod 18, and thus the angle of sharpening block 22, with respective to cutting implement 8. Angle adjustment assembly 20 preferably comprises collar 34 and hinge 36. Collar 34 is adapted to snugly fit over the dimensions of base rod 16 such that collar 34 can be movably fixed along the distance of base rod 16 extending from base 12. Collar 34 can be fixed at a location along base rod 16 by tightening or loosening wheel 38, which presses or releases a threaded rod (not depicted) that is part of wheel 38 from base rod 16. Hinge 36 is functionally connected to collar 34 such that hinge 36 moves about collar 34 within a plane perpendicular to cutting implement 8. Hinge 36 is, in turn, functionally connected to guide rod 18 such that guide rod 18 moves about hinge 36 in a plane perpendicular to the plane of hinge 36.

Sharpening block 22 is slidably mounted on guide rod 18, preferably by sliding sharpening block 22 over guide rod 18 via aperture 40 that extends throughout the center of sharpening block 22 from end to end. Sharpening block 22 preferably includes four sides, with at least two preferably having a grinding or honing material 42 mounted on the faces of those sides to allow sharpening block 22 to simply be rotated about guide rod 18 to select a different honing material. Grinding or honing material 42 may take any of a number of forms. Such honing material 42 typically ranges from a coarse grit to a fine grit (for example, 80 to 1000 grit) and multiple honing materials are used in successive iterations during the sharpening process to achieve the desired sharpening effect. In a contemplated embodiment, honing material 42 comprises a leather strap (or a synthetic material) embedded with a diamond paste or other abrasive or polishing compounds (or a leather strap to which a diamond paste has been applied to the strap's surface), which is intended for use as a final honing material 42. Sharpening block 22 may have hand/finger depressions and other such features that provide an ergonomic benefit, as well as a functional benefit such as protecting the user's fingers from the cutting edge of cutting implement 8.

Angle adjustment assembly 20 allows guide rod 18, and thus sharpening block 22, to move both parallel and perpendicular to cutting implement 8 to allow sharpening block 22 to continuously contact the cutting edge of cutting implement 8 when in operation. The angle of contact between sharpening block 22 and the cutting edge of cutting implement 8 can be adjusted based on the positioning of collar 18 along base rod 16. In the preferred embodiment, knife sharpener 10 is attached to a mounting platform (not depicted) that has sufficient width and weight to provide a stable foundation for when knife sharpener 10 is in use. It is contemplated that such a mounting platform may take the form of a level sheet of stone or other suitable material for providing a stable mounting platform with a level surface to which knife sharpener 10 may be attached by any of a number of well-known means, and the mounting platform may be movable. An example of one embodiment of such a movable mounting platform is shown in FIG. 1 as item 54.

Turning now to FIG. 2, clamping mechanism 14 is depicted but the other elements discussed above are not shown for purposes of clarity in describing additional elements and features of the present invention. Also depicted are depth key 44 and alignment guide 46 (a storage space is provided for key 44 and guide 46, preferably, although not depicted in FIGS. 1 through 3). Depth key 44 includes two prongs 48 that are designed to align with and slide through depth control apertures 30 and extend through the apertures from one vertical member 24 to the other. In this manner, prongs 48 create a fixed horizontal plane on which cutting implement 8 may be situated prior to using knife sharpener 10, thus allowing for repeatable, consistent positioning of cutting implement 8 over the course of multiple sharpening sessions. The depth of cutting implement 8 with respect to clamping mechanism 14 and sharpening block 22 affects the angle of application of sharpening block 22 to the cutting edge of cutting implement 8 when knife sharpener 10 is in use. Depth key 44 can be used with any of the three sets of depth control apertures 30 to adjust the depth of cutting implement 8 within clamping mechanism 14, although the user's choice may depend on the height of cutting implement 8. Additionally, greater clamping power can be applied to cutting implement 8 by use of the lower set of apertures 30 than the upper set of apertures 30, which may affect the user's selection of depth control apertures 30 as well. Alternative embodiments may include any of a number of depth control apertures 30 arranged at a variety of locations along the height of vertical members 12. Alignment guide 46 allows precise placement of cutting implement 8 in clamping mechanism 14 such that the tip of cutting implement 8 is set at a repeatable, consistent distance from vertical members 24 over the course of multiple sharpening sessions. Alignment guide 46 is preferably a thin metal strip having visible markers for measuring the distance from vertical members 24, and further includes two apertures designed to align with depth control apertures 30 and allow prongs 48 to pass through. In this manner, alignment guide 46 can be affixed to vertical members 24 via use of depth key 44, and the alignment and positioning of cutting implement 8 can be repeatably and consistently controlled with depth key 44 and alignment guide 46 over the course of multiple sharpening sessions.

With reference to FIG. 3, the components of angle adjustment assembly 20 are readily visible. As discussed above, collar 34 is slidably movable on base rod 16 and may be fixed in a position by actuating wheel or screw 38, which presses against base rod 16 to resist movement by collar 34. Hinge 36 is connected to collar 34 by pin 50, and guide rod 18 is connected to hinge 36 by pin 52. This arrangement provides the benefits and functionality discussed above with respect to FIG. 1.

Utilizing the structure discussed with respect to FIGS. 1 through 3, the present invention also encompasses a method of sharpening cutting implement 8. Cutting implement 8 is secured in clamping mechanism 14 between vertical members 24, wherein the necessary force to secure cutting implement 8 is provided by actuating screws 28. Sharpening block 22 is drawn across the cutting edge of cutting implement 8 at a specified angle. The angle is selected by, inter alia, altering the position of collar 34 on base rod 16, altering the depth of cutting implement 8 in clamping mechanism 14 via use of depth key 44, and/or adjusting the alignment of cutting implement 8 via use of alignment guide 46. By using the depth key and alignment guide, cutting implement 8 can be accurately and consistently placed in clamping mechanism 14 from one sharpening session to the next, the benefit being, inter alia, less material is removed from cutting implement 8 each time because the same sharpening angles are maintained, thereby making the sharpening process more efficient. Sharpening block 22, which is pivotally mounted on guide rod 18 such that it may slide (reciprocally) along guide rod 18 and rotate about guide rod 18 (there is a sharpening block 22, and its accompanying guide rod 18, angle adjustment assembly 20, and base rod 16, on both sides of clamping mechanism 14 in the preferred embodiment of the present invention to allow simultaneous sharpening of both sides of the cutting edge of cutting implement 8), can be moved to control its angle of contact with cutting implement 8 by moving collar 34 (and therefore hinge 36) relative to the vertical plane of cutting implement 8. In operation after clamping a cutting implement 8 in a fixed position and setting the desired sharpening angle, sharpening block 22 is moved reciprocally along guide rod 18 as honing material 42 on sharpening block 22 is applied along the length of the cutting edge of cutting implement 8, repeatedly as necessary to obtain the desired sharpening effect. With the dual sharpening blocks of the present invention, sharpening blocks 22 may be applied in an alternating fashion, one at a time for a repeated number of strokes before applying the opposite sharpening block, or in any manner desired by the user, although alternating sharpening blocks 22 has been shown to be a very efficient method of sharpening cutting implement 8. Through the application of honing materials 42 of grits progressing from coarse to fine, the desired angle of the cutting edge of cutting implement 8 is created (set). Once the user feels a burr being created on one side of the cutting edge, that indicates that the ridge of the cutting edge is rolling over and that the angle is created (set), at which point it is appropriate to being polishing the cutting edge with finer grits. In using a leather strap embedded with a diamond paste as a polishing or finishing step, it is possible that will be preferred that a slightly different angle (on the order of roughly 0.5 to 1 degree of difference) be selected before applying the leather strap to the cutting edge of cutting implement 8 to achieve a better sharpening effect.

In an alternative embodiment, a vertical bracing element (not depicted) may be used to prevent deflection of cutting implement 8 at its tip. For example, the vertical bracing element may extend vertically from base 12 to a desired height at which the tip of cutting implement 8 is located, and the bracing element may have a notch or other means for holding the tip of cutting implement 8 in a fixed position to resist deflection of the tip during a sharpening session, which may be a problem encountered when cutting implement 8 is a flexible, long, and/or thin knife (such as a filet knife). In another alternative embodiment (not depicted), angle adjustment assembly 20 comprises a ball and socket, interlocking eyelets, or other device providing coupling of guide rod 18 to base rod 16 while allowing a free range of motion for the uncoupled end of the guide rod 18. In yet another alternative embodiment (not depicted), base rod 16 could alternatively comprise a rack-and-pinion assembly including two "rack" guide rods extending out from base 12, one to each side, and two "pinion" wheels for adjusting the position of the guide rods, one wheel for each guide rod. Alternatively, a single wheel could be used to concurrently adjust the positioning of the two base rods wherein the base rods interact with opposite sides of the single wheel.

An additional alternative embodiment may have guide rod 18 coupled to base rod 16 in a fixed location, wherein the sharpening angle is adjusted by moving base rod 16 (and therefore the anchor point of guide rod 18) further from or nearer to the vertical plane of cutting implement 8. Yet another alternative embodiment (not depicted) may enable base rod 16 to be selectively positioned such that the angle between base rod 16 and vertical members 24 (and thus cutting implement 8) is adjustable, thereby alternating the sharpening angle relative to the vertical plane of cutting implement 8. Another alternative embodiment similarly allows for raising and lowering the coupled end of guide rod 18, which would in turn alter the sharpening angle. Further alternative embodiments include the use of multiple base rods 16 at selected positions along base 12, or a base rod 16 that may be selectably positioned at any of a number of positions along base 12. Another embodiment of the present invention includes a built-in "C-clamp" for removably affixing base 12 to a table or other surface.

Additional alternative embodiments may use different systems for controlling the depth of cutting implement 8 between vertical members 24. One example (not depicted) is a slidable shoulder located between vertical members 24 that slides up and down vertical members 24. Another example (not depicted) is adjustable clips located on vertical members 24 in positions that allow the clips to support cutting implement 8 when implement 8 is placed between vertical members 24. Still another example (not depicted) is the use of horizontal pins located within vertical channels of vertical members 24 such that said pins can be moved and fixed at various positions within said vertical members 24. Any of a number of other depth control systems are also contemplated by the present invention for use in setting and adjusting the depth of cutting implement 8 when it is placed into clamping mechanism 14.

Whereas the figures and description have illustrated and described the concept and preferred embodiment of the present invention, it should be apparent to those skilled in the art that various changes may be made in the form of the invention without affecting the scope thereof. The detailed description above is not intended in any way to limit the broad features or principles of the invention, or the scope of patent monopoly to be granted.

What is claimed is:

1. An apparatus for holding a cutting implement including a cutting edge and a tip in a fixed vertical plane and sharpening said cutting edge, said apparatus comprising:

a. a base, a clamping mechanism mounted on the top of said base, at least one base rod attached to said base and extending in a generally horizontal plane such that said at least one base rod is oriented perpendicular to said fixed vertical plane of said cutting implement;

b. a plurality of guide rods movably coupled to said at least one base rod via angle adjustment assemblies such that said guide rods extend above the horizontal plane of said at least one base rod, said angle adjustment assemblies allowing movement of said guide rods along at least two perpendicular axes of movement.

c. a sharpening block slidably and rotatably mounted to each of said plurality of guide rods.

2. The apparatus of claim 1 wherein each of said angle adjustment assemblies includes a collar slidably mounted over said at least one base rod, a hinge having first and second ends, said first end coupled to said collar in a manner allowing said hinge to move only in a vertical plane perpendicular to said fixed vertical plane of said cutting implement, said second end coupled to a guide rod in a manner allowing said guide rod to move only in a plane perpendicular to said plane of movement of said first end.

3. The apparatus of claim 2 wherein said collar includes a securement mechanism for fixing the position of said collar with respect to said at least one base rod.

4. The apparatus of claim 3 wherein said securement mechanism comprises a screw passing through an aperture in a portion of said collar, said aperture aligned generally perpendicular to said at least one base rod.

5. The apparatus of claim 1 wherein said clamping mechanism includes two vertical members mounted to said base, said vertical members opposing each other and located adjacent to each other, each of said vertical members comprising a base and tip.

6. The apparatus of claim 5 wherein said vertical members taper in thickness as the height from said base to said tips of said vertical members increases.

7. The apparatus of claim 6 wherein said vertical members comprise right triangle prisms.

8. The apparatus of claim 5 further comprising depth control mechanism selectively controlling the depth of said cutting implement within said clamping mechanism.

9. The apparatus of claim 8 wherein said vertical members include at least one set of depth control apertures.

10. The apparatus of claim 8 wherein said at least one set of depth control apertures including two apertures passing through both of said vertical members.

11. The apparatus of claim 10 further comprising a depth control key including two pins designed to pass through said at least one set of depth control apertures such that said pins bridge any distance existing between said vertical members.

12. The apparatus of claim 1 wherein said sharpening block includes a channel passing through the length of said sharpening block and adapted to receive said guide rod.

13. The apparatus of claim 1 wherein said sharpening block includes a rigid core with at least one flat exterior face, and a sharpening material applied to said at least one flat exterior face.

14. The apparatus of claim 1 wherein said sharpening material comprises leather to which a diamond paste has been applied or embedded.

15. The apparatus of claim 1 further comprising said base attached to a level top surface of a movable mounting platform.

16. The apparatus of claim 1 further comprising a brace for the tip of said cutting implement, said brace including a member extending vertically from said base, said member including a notch at the top of said member for receiving the tip of said cutting implement.

17. The apparatus of claim 1 further comprising an alignment guide, said alignment guide including a strip of material with markings for identifying the distance from a first end of said guide along the length of said guide, said guide adapted to mount to said clamping mechanism such that said guide extends from said clamping mechanism parallel to said fixed vertical plane of said cutting implement.

18. The apparatus of claim 1 wherein said clamping mechanism is affixed to said base in a manner such that said clamping mechanism may be adjusted in a vertical direction with respect to said base.

19. The apparatus of claim 1 wherein said at least one base rod is movably attached to said base.

20. The apparatus of claim 1 further comprising a rack-and-pinion assembly interfacing with said at least one base rod for adjusting the position of said at least one base rod in a horizontal direction.

21. The apparatus of claim 1 wherein said at least one base rod curves vertically as it extends horizontally from said base.

22. The apparatus of claim 1 wherein each of said angle adjustment assemblies includes a ball-and-socket mechanism including a ball and a socket wherein one of said ball or socket is coupled to said at least one base rod and the other of said ball or socket is coupled to said guide rod.

23. An apparatus for sharpening a knife comprising:

a. a clamping mechanism for holding said knife;

b. at least one base rod mounted adjacent and perpendicular to said clamping mechanism, said at least one base rod selectively adjustable along at least two perpendicular axes of movement;

c. a plurality of sharpening elements wherein at least one of said sharpening elements is located on either side of said clamping mechanism and slidably mounted on a guide rod, said guide rod affixed to said at least one base rod such that said guide rod is movable in two directional planes perpendicular to each other.

* * * * *